United States Patent [19]

Mollenkopf et al.

[11] 3,994,677

[45] Nov. 30, 1976

[54] ROTARY KILN WITH PLANETARY COOLERS

[75] Inventors: Hans Mollenkopf, Neubeckum; Karl Eiring, Oelde; Heinz-Herbert Schmits, Rheda-Wiedenbruck; Antonius Vering, Vorhelm; Rainer Philipp, Ahlen; Jürgen Wurr; Otto Heinemann, both of Ennigerloh; Helmut Berief, Beckum, all of Germany

[73] Assignee: Polysius AG, Neubeckum, Germany

[22] Filed: Apr. 14, 1975

[21] Appl. No.: 567,859

[30] Foreign Application Priority Data

Apr. 17, 1974 Germany ..... 2418564

[52] U.S. Cl. ..... 432/80

[51] Int. Cl.[2] ..... F27B 7/38

[58] Field of Search ..... 432/80, 81, 432/83, 103, 116, 117

[56] References Cited

UNITED STATES PATENTS

| | | | |
|---|---|---|---|
| 3,502,311 | 3/1970 | Jensen | 432/80 |
| 3,792,961 | 2/1974 | Theil | 432/80 |
| 3,811,824 | 8/1974 | Theil | 432/80 |
| 3,813,211 | 5/1974 | Grommesen | 432/80 |
| 3,844,709 | 10/1974 | Ghestem | 432/80 |

*Primary Examiner*—John J. Camby
*Assistant Examiner*—Henry C. Yuen
*Attorney, Agent, or Firm*—Marshall & Yeasting

[57] ABSTRACT

A plurality of cooling tubes are arranged in planetary fashion about the periphery of the kiln. An inlet for each cooling tube includes a transition member extending from one end of each tube, which transition member comprises the wall of an inclined frustum whose base lies on the end of the cooling tube in a plane perpendicular to the axis of the tube. An inlet tube has one end intersecting the wall of the kiln and its other end intersecting the wall of the transition member, two surface lines of the transition member being tangent to the inlet tube.

4 Claims, 5 Drawing Figures

ROTARY KILN WITH PLANETARY COOLERS

BACKGROUND OF THE INVENTION

This invention relates to a rotary kiln with planetary coolers, having a number of cooling tubes disposed in planetary fashion about the periphery of the rotary kiln and each connected with the rotary kiln via an inlet tube attached to the rotary kiln and a transition member acting as an inlet chute to the cooling tube.

In a known rotary kiln with a planetary cooler (German application OLS No. 1,508,518) the cylindrical cooling tubes on the side remote from the rotary kiln are led to the admission point of the inlet tube, and on the side adjacent the rotary kiln are bounded by an inclined cylindrical surface which when the cooling tube is above the kiln axis acts as an inlet chute for the material. The chief disadvantage of this known construction lies in the large height through which the material has to drop on passing from the rotary kiln to the cooling tubes, which results in considerable abrasion and wear of the wall lining. With this construction the air feed is also unsatisfactory, with a sharp deflection, disadvantageous from the flow aspect, of the air between the cooling tubes and the inlet tube.

A rotary kiln with a planetary cooler is also known (German application OLS No. 2,225,097) wherein between the individual cooling tubes and the inlet tubes connected to the rotary kiln there is provided a transition member which on the side remote from the rotary kiln is formed as an inclined inlet chute. With this type of construction the height through which the material drops on passing from the rotary kiln to the cooling tubes is much less than with the device mentioned previously; in addition the air feed conditions are more favourable. However, a disadvantage of this construction is that the connection of the inlet tube to the cooling tube causes dead spaces to occur in the transition zone, which result in deleterious accumulations of material. In addition the transition member between the cooling tubes and the corresponding inlet tubes in this known construction is expensive to construct.

SUMMARY OF THE INVENTION

The invention is thus directed to the problem of obviating the defects of the known constructions in developing a rotary kiln with planetary coolers of the type initially described, wherein with the material falling through only a small height, and more effective air supply from the flow aspect, there is provided a transition zone between the cooling tubes and the inlet tubes of a type which is simple to manufacture.

According to the invention this problem is solved in that the transition member comprises the wall of an inclined frustum extension of the inlet tube, whose imaginary circular base facing the cooling tube lies perpendicular to the cooling tube axis and whose side remote from the cooling tube is bounded by the wall of the inlet tube, and wherein surface lines of the transition member constitute tangents to the wall of the inlet tube.

With the transition member between each cooling tube and the corresponding inlet tube formed in this manner, deleterious dead spaces wherein the material can accumulate are avoided, as will be explained in detail with reference to an embodiment. In this way one also achieves an air supply which is highly effective from the flow aspect.

A further particular advantage of the construction in accordance with the invention lies in the ease with which the transition member may be manufactured. It may for instance be made by rolling from a single piece, which not only permits economical manufacture and the provision of high stability, but in addition because of the avoidance of corners and edges results in good adhesion of the refractory lining.

The rotary kiln 1 is provided at its periphery with a number of cooling tubes 2 disposed in planetary fashion and each connected to the rotary kiln by a transition member 3 and an inlet tube 4. The supports for the cooling tubes 2, which are of no further interest in the present matter, are indicated at 5.

Figure 3:
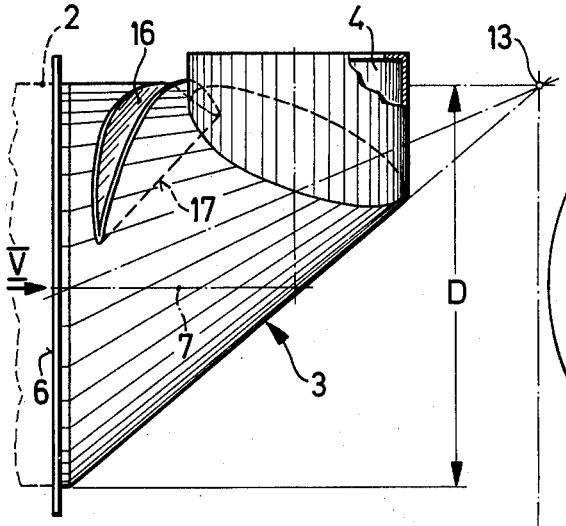
FIG. 3 is a side elevation of the transition zone between the rotary kiln and a cooling tube, with the latter in its lower position.
Figure 5:
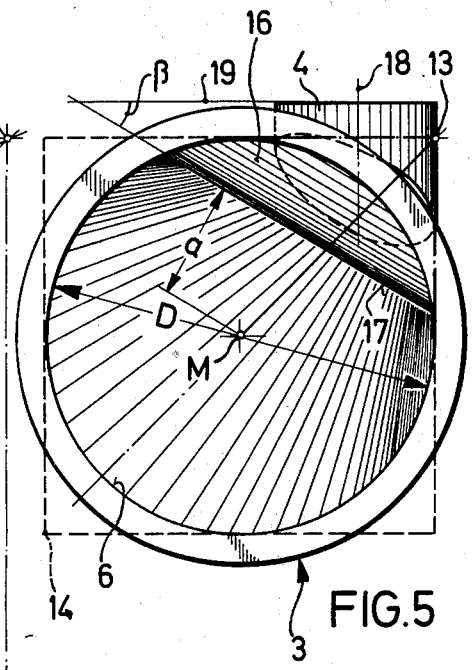
FIG. 5 is an elevation looking in the direction of the arrow V in FIG. 3.
Figure 4:
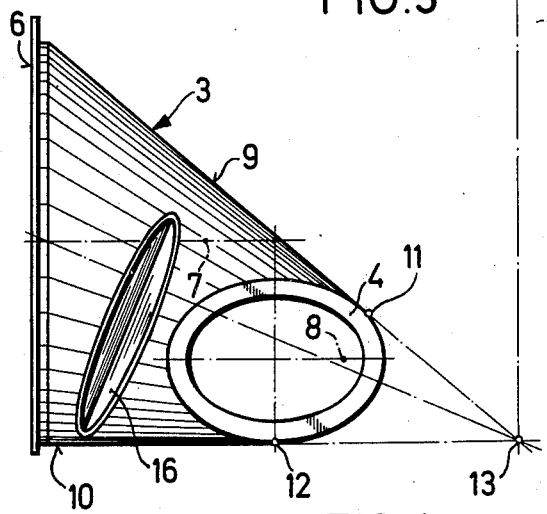
FIG. 4 is a plan view of the transition zone according to FIG. 3.

The transition member 3, whose details can be seen from FIGS. 3–5, comprises the wall of an inclined frustum extending from the inlet tube 4 whose imaginary circular base 6 facing the cooling tube 2 lies perpendicular to the cooling tube axis 7, and which at its side remote from the cooling tube is bounded by the wall of the inlet tube 4.

In the embodiment shown, the inlet tube 4 is of elliptical cross-section, with the major axis 8 of this section extending generally parallel to the cooling tube axis 7.

As may be seen from FIG. 4, two surface lines 9 and 10 of the transition member 3 form tangents to the wall of the inlet tube 4 (the points of contact of these surface lines 9 and 10 with the wall of the inlet tube 4 are indicated at 11 and 12).

Figure 1:
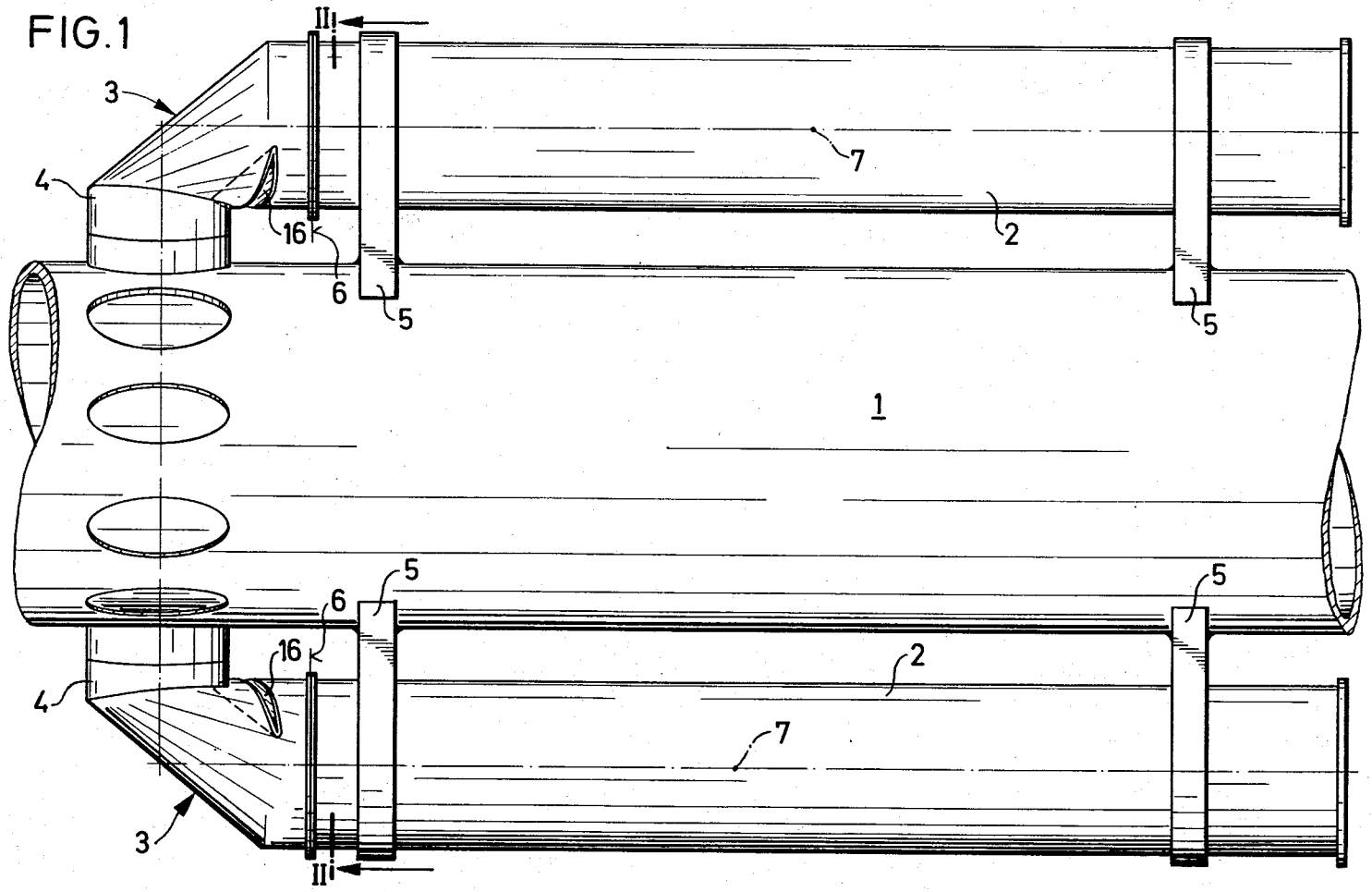
FIG. 1 is a side elevation with portions broken away of a rotary kiln and planetary coolers in accordance with the invention.
Figure 2:
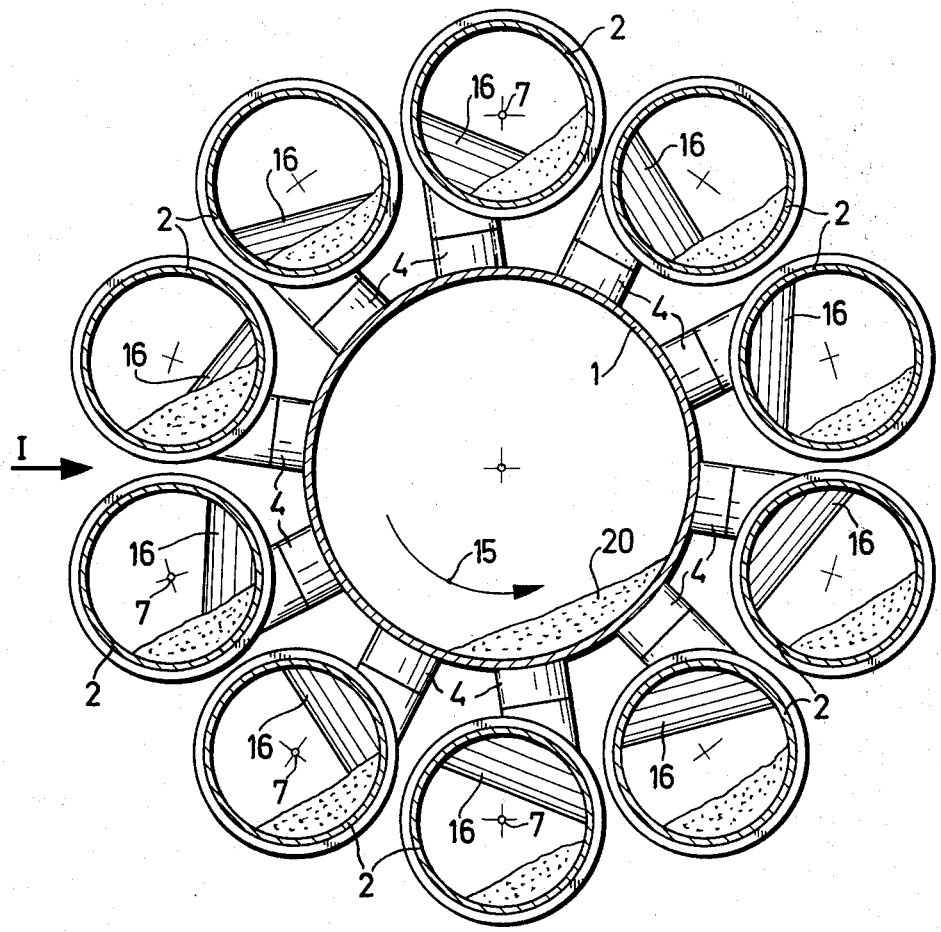
FIG. 2 is a section on the line II—II of FIG. 1.

If the imaginary tip 13 of the frusto-conical transition member 3 is projected onto a plane containing the base surface 6 (see FIG. 5) in this projection the tip 13 coincides generally with the corner of a square 14 forming a boundary to the circular base surface 6. In this manner, in the projection referred to (FIG. 5) the inlet tube 4 is offset in relation to the base surface 6 (with its middle point M) in the direction of rotation of the kiln (arrow 15, FIG. 2).

In the vicinity of the mouth of the inlet tube 4 there is disposed in the transition member 3 a control dam 16 whose edge 17 forms an angle $\beta$ of 25°–35° with a plane 19 perpendicularly intersecting the axis 18 of the inlet tube 4. If this edge 17 is projected onto a plane containing the base surface 6 of the transition member 3 (see FIG. 5), the distance $a$ of this edge 17 from the centre point M of this base surface is between 0.25 and 0.4 times the diameter D of the base surface.

When the planetary cooler is in operation, the material 20 falls from the rotary kiln 1 through the inlet tube 4 into the cooling tube 2 disposed immediately below, with the shape of the transition member 3 ensuring a small drop for the material. The frusto conical shape of the transition member 3 in conjunction with the type of connection to the elliptical inlet tube 4 also ensures an effective air supply. Any form of dead space wherein material could accumulate or which could have a deleterious effect on the air supply is avoided.

As the cooling tubes move upwards from their lowermost position, the material slides from the transition member 3 into the adjacent cooling tube 2. In the upper positions of the cooling tubes, the control dams 16 prevent any return of the material to the rotary kiln.

While in the embodiment shown the inlet tube 4 has an elliptical cross-section, a construction with a circular cross-section is also possible within the scope of the invention. Here again two surface lines of the frusto conical transition member 3 are tangential to the inlet tube wall.

We claim:

1. A rotary kiln with planetary coolers for material discharged from the kiln, comprising a plurality of cooling tubes for contacting the material with incoming air, which are arranged in planetary fashion about the periphery of the kiln, and an air-inlet tube of elliptical cross-section extending from the periphery of the kiln at one end of each of said cooling tubes, the major axis of said elliptical cross-section being generally parallel to the axis of the corresponding cooling tube, wherein the improvement comprises a transition member, extending from the end of each cooling tube to the corresponding air-inlet tube, which provides a smooth transition for the airflow from the cross-section of the cooling tube to the cross-section of the air-inlet tube, said transition member comprising the wall of a frustum of an inclined cone whose base lies on the end of the cooling tube in a plane perpendicular to the axis of the tube, and whose truncated end lies on the end of the air-inlet tube, two straight lines lying on the surface of such frustum being tangent to opposite sides of the air-inlet tube.

2. A rotary kiln with planetary coolers for material discharged from the kiln, comprising a plurality of cooling tubes for contacting the material with incoming air, which are arranged in planetary fashion about the periphery of the kiln, wherein the improvement comprises a transition member on the end of each cooling tube that comprises the wall of a full frustum of an inclined cone whose base lies on the end of the cooling tube in a plane perpendicular to the axis of the cooling tube, each transition member being intersected by an air-inlet tube extending from the periphery of the kiln, the intersection of the transition member and the air-inlet tube being generally elliptical and consisting of the truncated end of said frustum, lying in a plane inclined to the axis of the air-inlet tube, whereby the transition member provides a smooth transition for the airflow from the cross-section of the cooling tube to the cross-section of the air-inlet tube.

3. A rotary kiln as claimed in claim 2, comprising a control dam in the transition member, adjacent to the mouth of the air inlet tube, whose edge forms an angle of 25° to 35° with a plane perpendicular to the axis of the inlet tube, and whose projection on the base plane of the transition member is spaced from the centre point of the circular base of such member by a distance which is from 0.25 to 0.4 times the diameter of such base.

4. A rotary kiln as claimed in claim 2, wherein the base of said frustum of a cone forms a circle coinciding with the end of the cooling tube and lying in a plane perpendicular to the axis of said tube, and said frustum is inclined at such an angle that the projection on said plane of the imaginary apex of said cone coincides generally with the corner of a square bounding said circle.

* * * * *